US005621285A

United States Patent [19]

Gorski et al.

[11] Patent Number: 5,621,285

[45] Date of Patent: Apr. 15, 1997

[54] DOUBLE IMMERSION PROJECTION CRT GUN

[75] Inventors: Richard M. Gorski, Arlington Heights; Kenneth A. Guzowski, Hoffman Estates, both of Ill.

[73] Assignee: Zenith Electronics Corporation, Glenview, Ill.

[21] Appl. No.: 432,320

[22] Filed: May 1, 1995

[51] Int. Cl.[6] ..... H01J 29/58

[52] U.S. Cl. ..... 315/382.1; 315/15; 313/414; 313/449

[58] Field of Search ..... 315/14, 15, 16, 315/17; 313/414, 449

[56] References Cited

U.S. PATENT DOCUMENTS

| | | | |
|---|---|---|---|
| 3,501,673 | 3/1970 | Compton | 315/15 |
| 3,633,065 | 1/1972 | Compton et al. | 315/14 |
| 4,169,239 | 9/1979 | Ehata et al. | 315/16 |
| 4,271,374 | 6/1981 | Kimura | 313/449 |
| 4,427,917 | 1/1984 | Mizushima et al. | 313/389 |
| 4,649,318 | 3/1987 | Kikuchi et al. | 313/449 |
| 4,728,846 | 3/1988 | Yasuda | 313/451 |
| 4,904,898 | 2/1990 | Penird et al. | 313/449 |
| 4,965,489 | 10/1990 | Shirai et al. | 313/449 |

*Primary Examiner*—Theodore M. Blum
*Attorney, Agent, or Firm*—Roland W. Norris

[57] ABSTRACT

A cathode ray tube electron gun (11) especially Well suited for projection-type cathode ray tubes is disclosed as having a main lens system where the upper end of the first accelerating electrode (21) fits through and within the lower end of the focus electrode (23) and the upper end of the focus electrode fits through and within the lower end of the second accelerating electrode (25). This construction and arrangement of the electrodes provides for larger apparent aperture(s) in both the decelerating lens gap and the accelerating lens gap or the main lens system which reduces spherical aberration to achieve a small spot size while providing increased grid separation for improved high voltage stability and an easily constructed gun.

36 Claims, 4 Drawing Sheets

DOUBLE IMMERSION PROJECTION CRT GUN

BACKGROUND OF THE INVENTION

1. Field of the Invention

The present invention relates generally to electron guns for cathode ray tubes (CRTs) and more specifically to electron guns of the type used with monochrome tubes suitable for projection-type television receivers.

2. Discussion of the Related Art

In order to produce a high resolution image on a CRT raster, the electron beam which is swept over the phosphor screen must be well focused and of small size. Spherical aberrations inherent in the electron-optical lenses of the electron gun which forms and emits the electron beam can create distorted beam "spots" at the screen which become larger-than-optimal size. In order to reduce spherical aberrations in the gun and, therefore, achieve a smaller or better focused beam spot, lenses with larger apparent apertures are desirable within the electron gun structure. However, lens sizes are limited by the size of the CRT neck which the gun must fit within. Past teachings which expound upon and address these problems include U.S. Pat. No. 4,904,898 to Penird et al.; U.S. Pat. No. 4,271,374, to Kimura; U.S. Pat. No. 4,649,318 to Kukuchi et al.; and U.S. Pat. No. 4,728,846 to Yasuda. Each of these references illustrate what is herein called an "immersion" lens, where the lower potential grid of the accelerating portion of the main lens is fitted partially within the higher potential grid in order to achieve a larger apparent lens aperture with reduced spherical aberration. Kimura, Penird et al., and Kukuchi et al. describe einzel-type guns, while Yasuda shows a bipotential type gun. All of the cited references show an immersion lens for the accelerating portion of the main lens, which is the G3–G4 gap in the bipotential gun of Yasuda and the G4–G5 gap of the einzel guns of the others.

A further consideration for the operation of such guns, as recognized in the Penird et al. patent, is that the electron guns in projection-type CRTs are operated at higher voltages than direct-view CRTs in order to provide adequate brightness. Therefore, high voltage stability of the gun and the prevention of arcing between the grids, becomes of increasing concern while still maintaining an adequate spot size. The cited references are somewhat elaborate structurally, thus requiring intensive effort in forming the grids and/or assembling them into the gun to prevent artifacts such as burrs and microcracks on the smooth surfaces of the grids which would lead to high voltage instability. Further effort must be taken with the cited designs to prevent axial misalignments of the grids in relation to one another which may skew the lensing action of the grids and result in beam asymmetries or large spot sizes.

Certain structural improvements to the gun designs of the prior art are, therefore, desired in order to decrease spot size for high resolution while gaining high voltage stability and ease of manufacture of the gun.

OBJECTS OF THE INVENTION

It is among the objects of the present invention to provide an electron gun with improved spot size performance and improved high voltage stability, the grids of which are easily manufactured and assembled into axial alignment.

In order to achieve these objects the present invention utilizes immersion lenses to increase the apparent lens apertures, thus reducing spherical aberration for both the decelerating and accelerating portions of the main lens. The structure of both these immersion lenses is optimized to improve spot size performance and stability at desirable operating voltages for projection-type guns. The electrical grids which form the main lens structure of a gun according to the present invention are formed from standard processes to reduce handling and are sized and arranged to permit use of standard mandrelling techniques to reduce assembly steps and decrease the occurrence of surface artifacts while providing increased physical separation between the grids, improving high voltage operating stability.

Other attendant advantages will be more readily appreciated as the invention becomes better understood by reference to the following detailed description and compared in connection with the accompanying drawings in which like reference numerals designate like parts throughout the figures. It will be appreciated that the drawings may be exaggerated for explanatory purposes.

BRIEF DESCRIPTION OF THE DRAWINGS

FIGS. 3A and 3B are used to explain the decelerating immersion lens (G3–G4).

FIG. 3A graphs focus voltage (VF) against G3 grid diameter (a) for given accelerating lens dimensions (e) and (g) and a family of G3–G4 axial spacings (c).

FIG. 3B graphs electron beam spot size (DS) at 5.0 milliamperes cathode current against G3 grid diameter (g) for given accelerating lens dimensions (e) and (g) and a family of G3–G4 axial spacings (c).

FIGS. 3C and 3D are used to explain the accelerating immersion lens (G4–G5).

FIG. 3C graphs focus voltage (VF) against G4 grid diameter (e) for given decelerating lens dimensions (a) and (c) and a family of G4–G5 axial spacings (g).

FIG. 3D graphs electron beam spot size (DS) at 5.0 milliamperes cathode current against G4 grid diameter (c) for given decelerating lens dimensions (a) and (c) and a family of G4–G5 axial spacings (g).

DETAILED DESCRIPTION OF THE PREFERRED EMBODIMENT

It will be understood by the reader that the gun bilaterally symmetrical and dimensions given apply to either half of the gun where applicable. As is common in describing guns, "front" and "upper" are away from the cathode while "back" or "lower" are towards the cathode. The term "electrode" and "grid" are used interchangeably herein, although an electrode or grid "element" may refer to only one portion of a grid.

Figure 1:
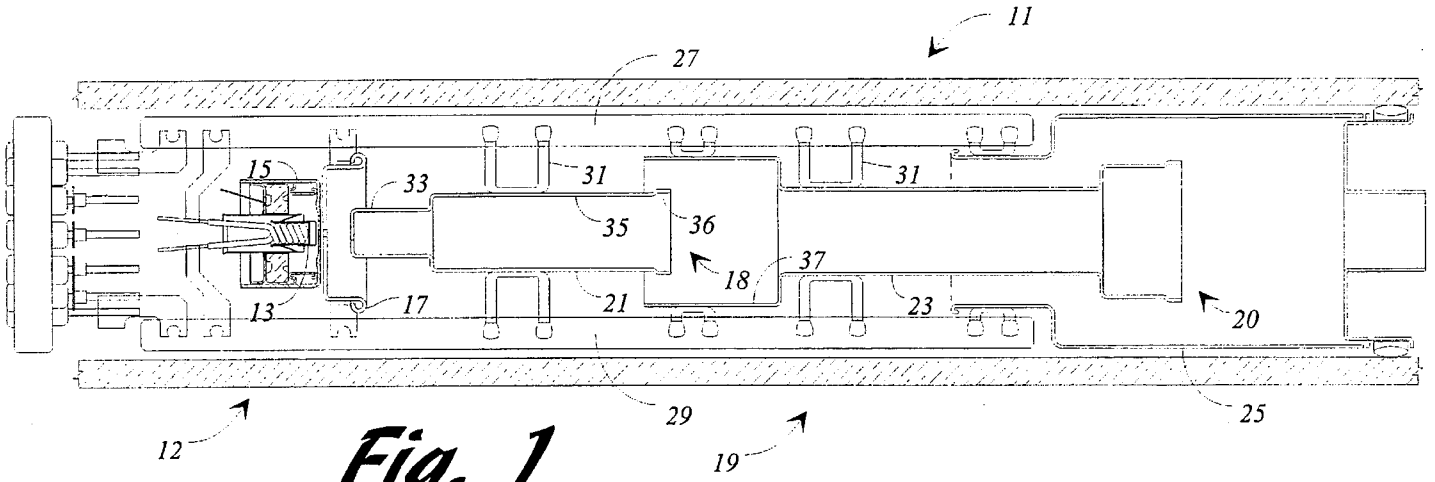
FIG. 1 is a schematic cross section of an einzel-type electron gun according to the present invention.
Figure 2:
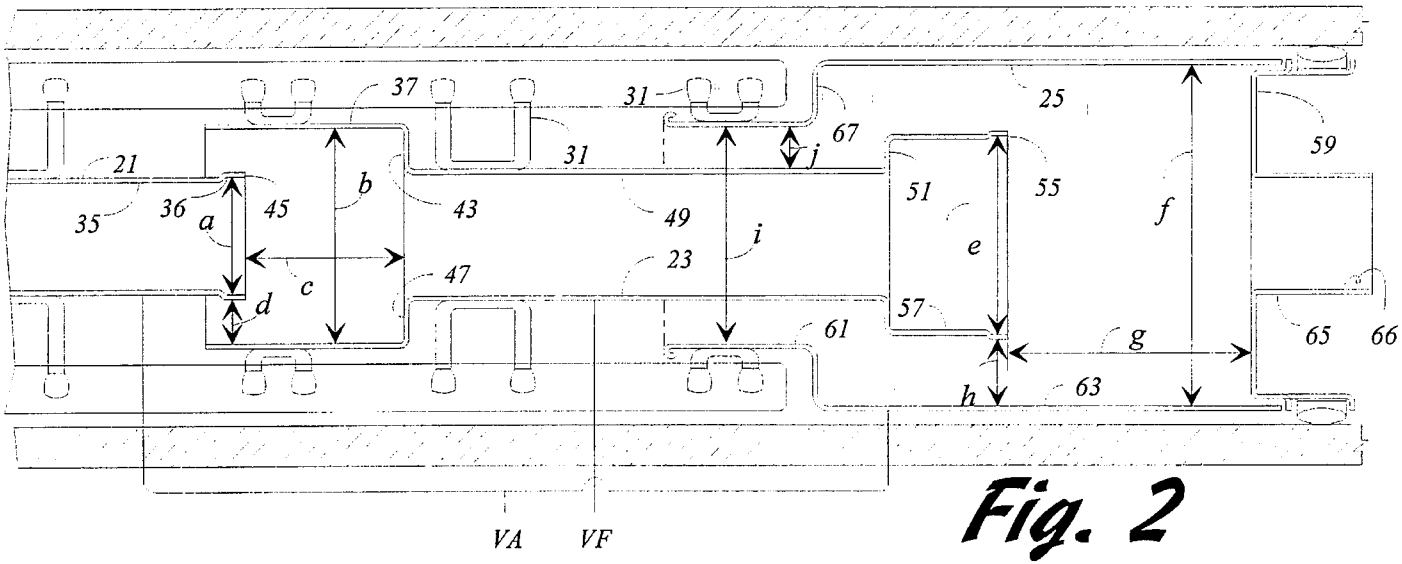
FIG. 2 is an enlarged view of the front end of the gun of FIG. 1.

Referring to FIGS. 1 and 2, an electron gun 11 according to the present invention is shown as an einzel lens type gun having a beam forming region 12 comprising a cathode 13, a G1 control grid 15 and a G2 accelerating grid 17. The present invention could encompass any electron gun having a main lens system consisting of a first decelerating lens region 18 and a second accelerating lens region 20 (FIG. 1), as the structures of these gun types are necessary to accommodate the two immersion lenses, as further explained below While described in the preferred embodiment as a single beam projection tube gun, the design principles disclosed are applicable to multibeam guns as well.

The gun 11 has a main lens system 19 having a G3 grid 21, a G4 grid 23, and a G5 grid 25. Each grid is fixed in place to two or more opposing insulative support members 27, 29, or beads, through claws, or appendages, labeled generically and collectively as 31, as is known in the art. Also as known, the G3 and G5 grids 21, 25 respectively, are accelerating grids which share a common anode voltage VA, while G4 is connected to a substantially lesser focus voltage VF. Each grid is preferably unitary, i.e., separate from the other grids and formed as a single piece requiring no further assembly during, or after mandrelling to assemble the gun. Unitary is meant to include, for example, the G4 grid 23 being a two piece subassembly constructed prior to mandrelling.

Computer simulations show that for a immersion-type electron lens, three of the critical dimensions responsible for spot size, operating focus voltage, and high voltage stability are the ratio of the immersed grid diameter to its outer grid diameter and the axial and radial spacing between these grids. These critical dimensions are labeled a-j in FIG. 1 and the effects of these dimensions are illustrated graphically in FIGS. 2A–2D.

The reader will understand that in the following discussion certain of the dimensions a-j may be arbitrarily fixed, or given, such as for purposes of reducing variables during computer simulation or graphing. These given dimensions are not to be confused with the finally derived dimensions for the physical embodiment, which are now contemplated to be:

a=0.300
b=0.556
c=0.50
d=0.116
e=0.508
f=0.872
g=0.40
h=0.170
i=0.556
j=0.116

The G3 grid 21 has a concentric cylindrical lower section 33 and upper section 35 with a slight end flare 36, all formed integrally in a single cup-like grid. The end flare 36 helps maintain the roundness of the grid as well as increasing the apparent aperture size of the decelerating lens. The G3 end flare 36 has a larger inside diameter (a) of 0.300 inches, than the G3 lower section 33 of 0.16 inches inside diameter. The G3 upper end serves as a first electrode element for the decelerating lens gap 18. Dimensions quoted are for a gun fitting a standard 29 mm (1.14 inches) diameter neck CRT. For example, dimensions b and f, referred to below, are maximized to fit in a 29 mm neck and therefore are constants on graphs 2A–2D. CRT necks of different diameter would, of course, have the dimensions quoted herein adjusted appropriately for maximum performance.

The G3 upper section 35 fits inside, or coloquially "is immersed in", the G4 lower section 37, which has an inside diameter (b) of 0.556 inches, to provide a large apparent aperture for the first, or decelerating, lens area 18 to reduce spherical aberration. The inside diameter (b) of the G4 lower section 37 is enlarged to the capacity dictated by the dimension available between the support beads 27, 29. The G4 lower end serves as the second electrode element of the decelerating lens gap 18.

The G4 lower front wall 43 of the preferred embodiment extends towards the longitudinal axis of the gun to mark the lower boundary 47 of the G4 middle section 49 which is 1.010 inches long and has a 0.30 inch diameter. The G4 middle section 49 ends at the front wall 51 of the G4 upper section 57 which extends perpendicular from the axis to within 0.166 inches dimension (h), of the G5 grid 25 in which it is immersed. The G4 upper end serves as the first electrode element of the accelerating lens gap 20.

The G5 grid 25 has a reduced diameter lower section 61 to accommodate mounting claws 31, a mid-section 63 forming the immersed accelerating lens 20 with G4 23 and an upper section 65 forming the getter shield for the gun. The G5 middle section adjacent the G4 upper end serves as the second electrode element of the accelerating lens gap 20.

Optimization of the Decelerating Lens Gap (18)

The optimization procedure is designed to determine critical mechanical dimensions so that high voltage stability and spot size are simultaneously improved over non-immersed equi-diameter cylinder lens designs.

First, in order to improve upon the high voltage stability of the decelerating gap over that of the non-immersed type, the electric field Emax across the radial gap (d) between G3 and G4 should be reduced from 360,000 volts per inch typical of non-immersed types to less than 200,000 volts/inch. Using a given G3 grid metal thickness, application of the high voltage stability constraint Emax<200,000 v/in to the G3 upper diameter (a) and G4 lower diameter (b) (which is maximized to fit within bead pillars 27, 29) requires that the G3 diameter (a) follow the relationship:

$$a<=b-2((Vacc-Vdec)/Emax)-2t, \qquad \text{Eq.(1)}$$

where

Vacc=Electric potential of G3,

Vdec=Electric potential of G4, b=G4 lower diameter maximized to fit within bead pillars, t=metal wall thickness, and a=G3 diameter.

Inserting the following predetermined exemplary values into Eq. (1), Vacc=30,000 volts, Vdec=9,200 volts, b=0.54" and t=0.012" the G3 diameter (a) must be less than or equal to 0.308" in order to provide improved high voltage stability in the decelerating lens gap 18.

Figure 3B:
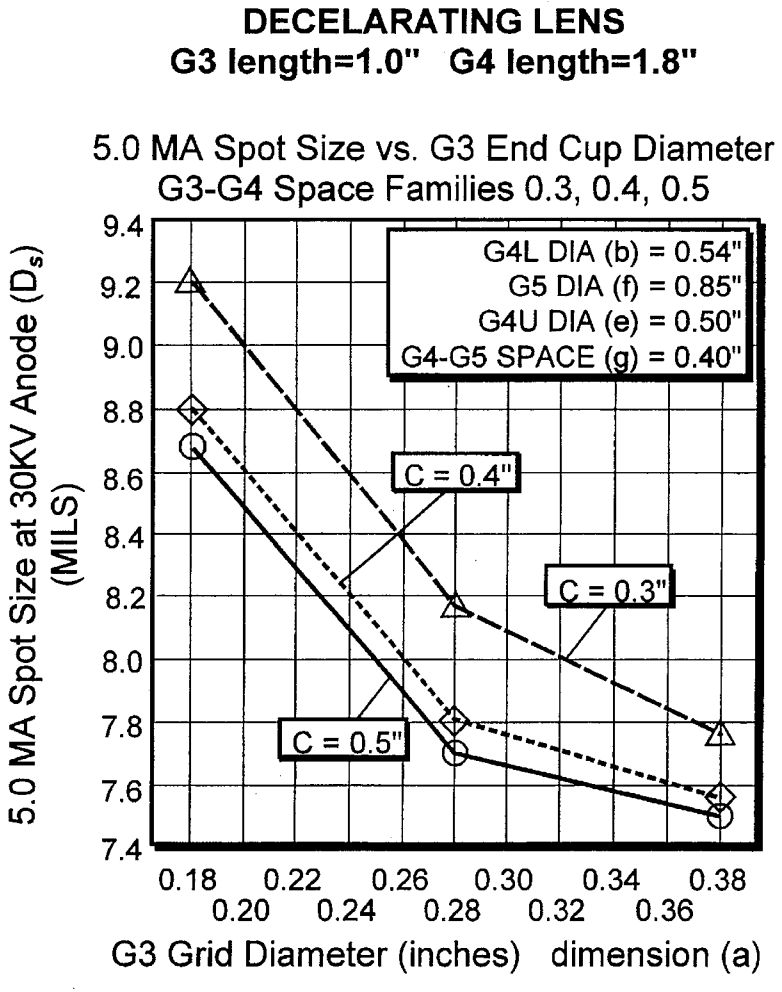
FIGS. 3A–3D are graphs from computer generated gun simulations showing the relationships between initial mechanical dimensions and the resulting electrical performance of the gun, including focus voltage (VF) and spot diameter (DS).
Figure 3A:
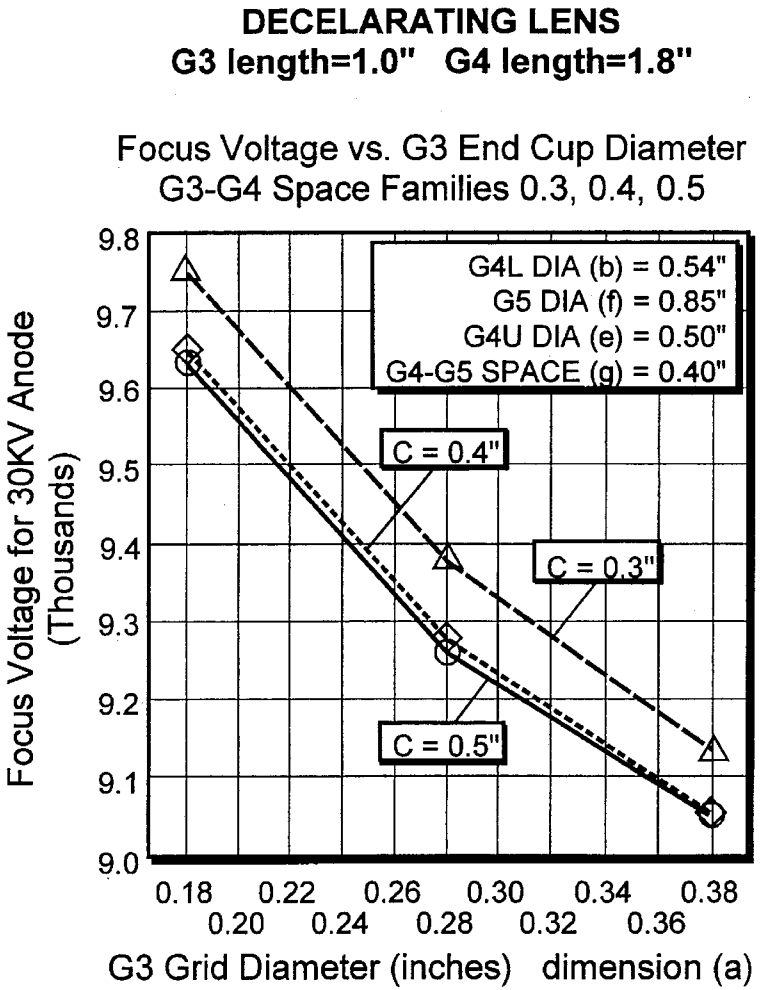

Using a G3 diameter (a)=0.308", the family of curves on FIG. 3A and FIG. 3B can now be used to derive dimensions for obtaining smallest spot size. Beginning with FIG. 3B, the family of curves indicates that spot size reduces as G3 diameter (a) increases. Therefore the G3 diameter (a) must be as large as possible for best spot size but less than or equal to 0.308" as determined previously for improved high voltage stability. This G3 diameter (a) will provide the largest apparent lens aperture that can be used while still maintaining the high voltage stability constraint. Using a G3 diameter (a)=0.308", FIG. 3B shows that further reduction in spot size can be obtained by shows that further reduction in spot size can be obtained by increasing the G3–G4 axial separation (c) up to about c=0.5". After this, further increase in dimension (c) produces no additional benefit. Since it is preferable to have minimum gun length while maintaining the smallest spot size, the G3–G4 axial separation (c) should not be increased any more than necessary for smallest spot size.

Thus the G3–G4 separation c=0.5" was selected With G3 upper diameter a=0.308" and G4 lower diameter b=0.54" giving a G3–G4 radial spacing (d)=0.104" and a resulting electric field magnitude across spacing (d) of about 200,000 volts per inch, thus improving high voltage stability and providing the largest apparent lens aperture that can be used within bead pillars 27, 29 thereby improving spot size over the equi-diameter cylinders typical of the non-immersed designs.

Using these dimensions, a=0.308", b=0.54", c=0.5", this optimized configuration for the decelerating lens 18 results in a focus voltage for the gun of about 9,200 volts (from graph 2A) which is within the voltage breakdown limit for the base of the tube. All values given above where determined with the accelerating lens parameters held constant and at the nominal values.

Optimization of the Accelerating Lens Gap (20)

The accelerating lens 20 is designed and optimized in similar fashion to the decelerating lens 18. First the high voltage stability constraint must be considered. Using the rule established for the decelerating lens gap we can determine the maximum G4 upper diameter (e) that will fit within the G5 middle section diameter f=0.85" (which has been maximized to fit within 29 mm neck diameter). Using the 200,000 volt per inch maximum electric field constraint, the maximum G4 upper diameter (e) becomes:

$$e<=f-2((Vacc-Vdec)/Emax)-2t, \quad \text{Eq.(2)}$$

where

Vacc=Electric potential of G5,

Vdec=Electric potential of G4, f=G5 diameter maximized to fit within 29 mm neck, t=metal wall thickness, and e=G4 upper diameter.

Inserting the following values into Eq. (2), Vacc=30,000 volts, Vdec=9,200 volts, f=0.85" and t=0.012" the maximum G4 upper diameter (e) that can be used is equal to 0.618" in order to provide improved high voltage stability.

A further constraint on the G4 diameter (e) involves the ability to use standard mandrelling techniques for improved grid alignment and reduction of grid damage. This requires that the G4 upper section outer diameter (e) plus twice the metal thickness (t), be small enough to fit through the G5 back end diameter (i) of 0.54" to allow for standard mandrelling techniques. Also a value (k) is chosen for the amount of side clearance or difference between outer diameter of G4 and inner diameter of G5 necessary so that G4 can easily pass through G5 lower diameter (i) without binding. Using (k)=0.012" the relationship can be written:

$$e<i-2t-2k=0.54"-2(0.012")-2(0.012")=0.496",$$

where i=G5 lower end diameter t=metal thickness k=clearance between diameters

The above constraint for standard mandrelling indicators that the maximum G4 upper diameter (e) allowable is 0.496". Since this value for G4 diameter is less than the 0.618" value determined from the high voltage stability constraint, (e)=0.496" becomes the controlling factor.

Figure 3D:
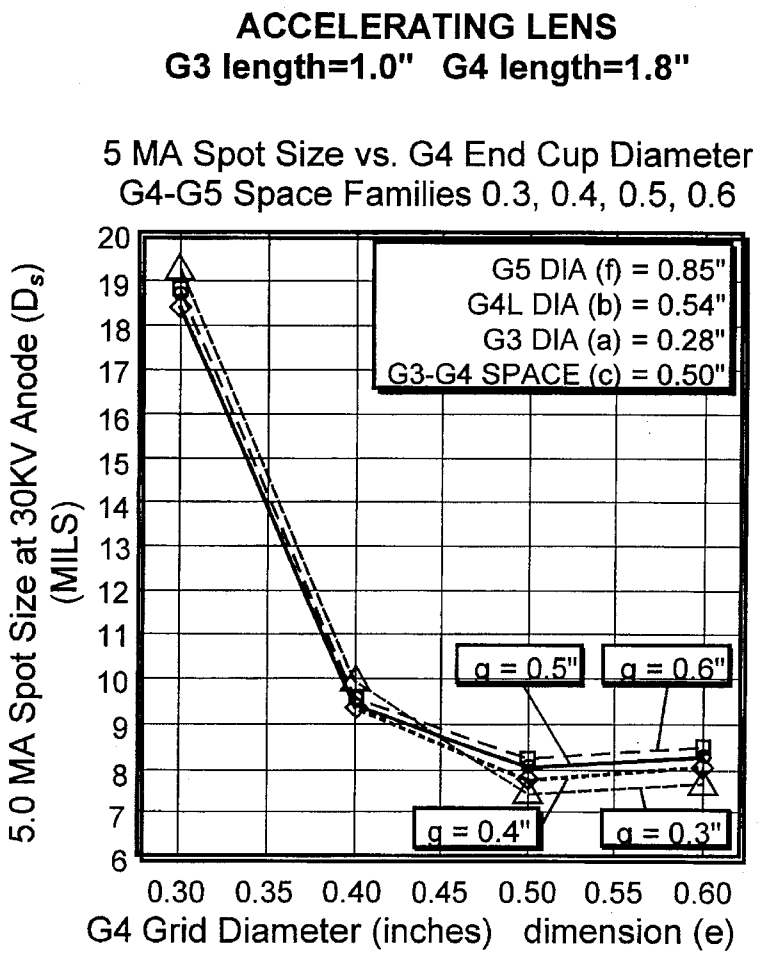
Figure 3C:
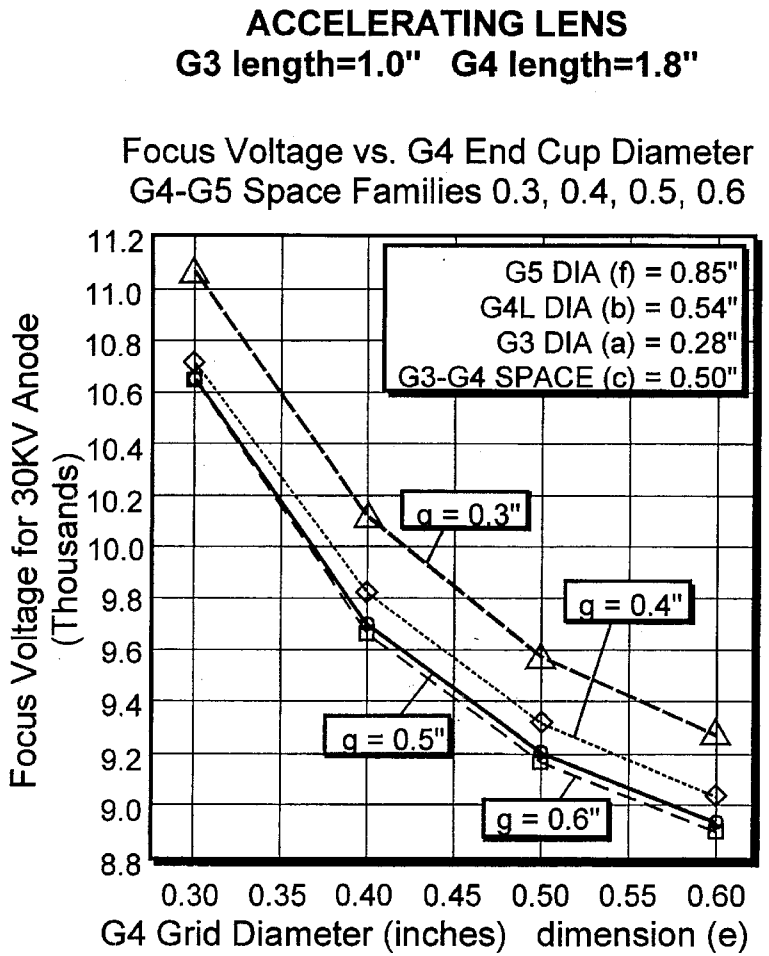

The family of curves in FIG. 3C and 3D can now be used to determine the optimum G4 diameter <=0.496, and the G4–G5 axial spacing (g). Beginning with FIG. 3D, the family of curves indicates that spot size reduces rapidly as G4 diameter increases up to about 0.45" where further increase produces little additional benefit. Therefore the G4 diameter (e) must be greater than or equal to 0.45" for best spot size but less than or equal to 0.496" as determined previously for standard mandrelling and high voltage stability. This G4 diameter will provide the largest apparent lens aperture that can be used while still maintaining the high voltage stability constraint and standard mandrelling.

Thus the G4 diameter (e)=0.496" was selected with a given G5 middle section diameter f=0.85" giving a G4–G5 radial spacing (h)=0.165". The resulting electric field magnitude across spacing (h) is about 126,000 volts per inch, thus greatly improving high voltage stability and providing the largest apparent lens aperture that can be used within the 29 mm neck diameter.

The graph of FIG. 3C can now be used to determine the G4–G5 minimum axial separation (g) required between the G4 upper end 55 and the G5 grid front wall 59 so that the getter shield aperture 66 creates no electron optical effect thus giving smallest spot size. The point of no electron optical effect occurs when the focus voltage no longer changes with further increase in G4–G5 axial separation (g). From FIG. 3C it is apparent that given a G4 diameter (e)=0.496", the getter shield aperture 66 has no significant electron optical effect when the G4–G5 axial separation (g) is greater than about 0.4". Thus in order to minimize gun length, the smallest G4–G5 separation that has no electron optical effect will be used, i.e., (g)=0.4".

Using these dimensions, (e)=0.496", (f)=0.85, (g)=0.4", this optimized configuration for the accelerating lens 20 has a resultant focus voltage for the gun of about 9,350 volts (from graph 2C) which is within the voltage breakdown limit for the base of the tube. (All values given above were determined with the decelerating lens parameters held constant and at the nominal values.)

As known in the art, high voltage instability generally manifests as electron field emission emanating from sharp edges or sharp burrs on the lower voltage grid of the gap due the formation of high electric field strength around the edge or burr. This teaches that since the lower voltage sharp edge 55 of the G4 grid 23 does exist in relation to G4–G5 radial spacing (h), and no lower voltage sharp edge exists for G4–G5 non-optical spacing (j), spacing (j) can be smaller than spacing (h) for equivalent high voltage stability. This is true for the preferred embodiment.

By studying the structure of the preferred embodiment it can be seen that the present invention provides a high performance electron gun with enlarged apparent lens apertures in both decelerating and accelerating lens structures of the main lens system thereby reducing spherical aberration and providing improved electron beam spot size while simultaneously providing for large grid separations to promote high voltage stability.

Figure 4:
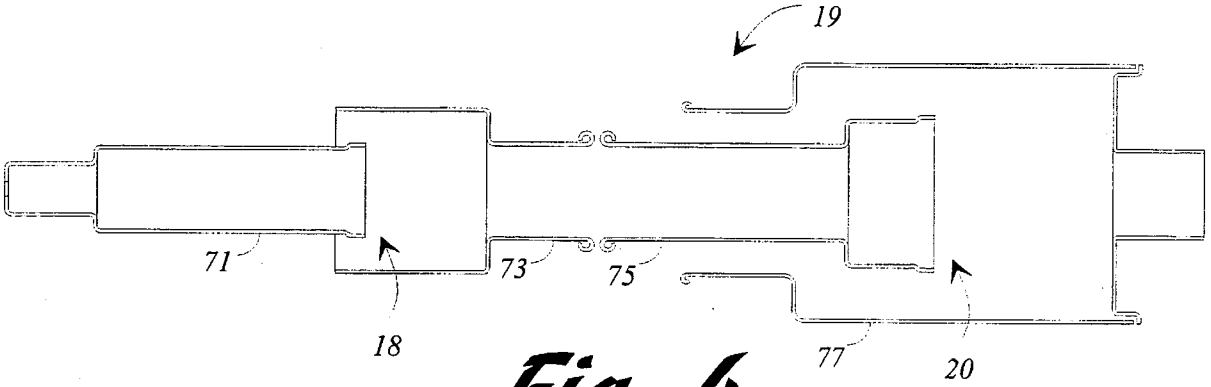
FIGS. 4 and 5 represent alternative embodiments among a range of possible gun designs according to the teachings of the present invention.
Figure 5:
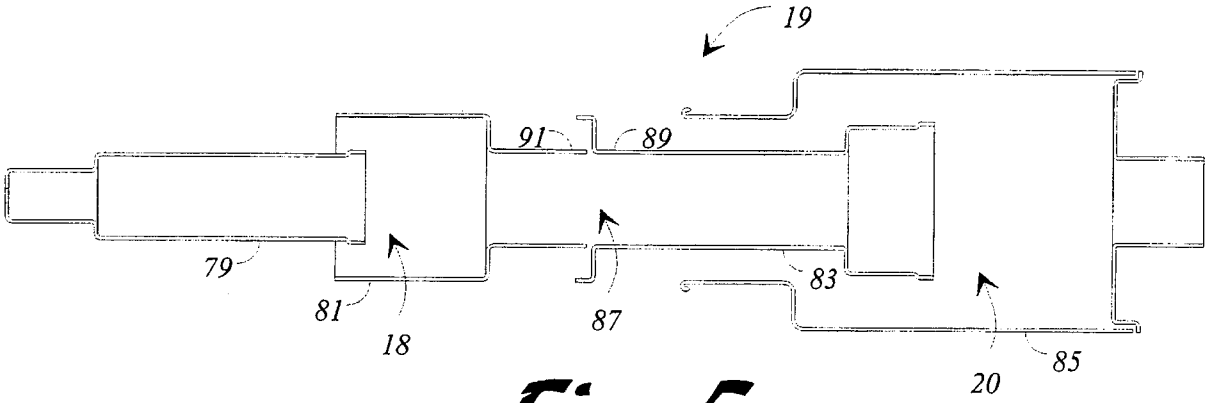

Alternative embodiments may include an increase in the overall number of grids in the main lens system such as seen in FIGS. 4 and 5. For example in FIG. 4, instead of the three grid main lens structure of the preferred embodiment, first through fourth grids 71, 73, 75, 77 may be used with the two intermediate grids 73, 75 for the main lens system 19 If necessary the intermediate grids 73, 75 may receive different voltages in accordance with maximum gun performance parameters. Another four grid design with first through fourth grids 79, 81, 83, 85 as seen in FIG. 5, has additional shaping of the intermittent grids 81, 83 between the main lens system 19 first grid 79 and fourth grid 85 to allow for a third immersed lens gap 87 between the decelerating lens gap 18 and the accelerating lens gap 20. This third immersed lens gap 87 is preferably of the accelerating type and would have the third electrode 83 supplied with a voltage higher than that supplied to the second grid 81 and lower than that supplied to the last/final grid element 85. As shown, the third grid lower end 89 is shaped to surround the second grid upper end 91. The grids of FIGS. 4 and 5 would preferably be relatively sized to accommodate conventional mandrelling according to one aspect of the present invention.

The present invention further provides for easily made grids which can be assembled into a gun with standard mandrelling techniques to ease manufacture and improve grid alignment, and also reduce the possibility of surface artifacts on the grids which further promotes high voltage stability.

While the present invention has been illustrated and described in connection with the preferred embodiments, it is not to be limited to the particular structure shown, because many variations thereof will be evident to one skilled in the art and are intended to be encompassed in the present invention as set forth in the following claims.

We claim:

1. An electron gun for a cathode ray tube comprising:

A. a beam forming region constructed and arranged to emit electrons and form them into a beam;

B. a main lens region constructed and arranged to receive the beam from the beam forming region and having:

1) a decelerating lens gap comprising:

a) a substantially tubular first electrode element, and b) a substantially tubular second electrode element surrounding at least a portion of the first electrode element;

2) an accelerating lens gap, comprising:

a) a substantially tubular third electrode element, and b) a substantially tubular fourth electrode element surrounding at least a portion of the third electrode element; and 3) the decelerating lens gap being located between the beam forming region and the accelerating lens gap.

2. The electron gun according to claim 1 wherein the second and third electrode elements are first and second ends of a unitary electrode, respectively.

3. The electron gun according to claim 2 wherein the outside diameter of the second end of the unitary electrode is less than the inside diameter of the,fourth electrode element whereby the second end of the unitary electrode is able to pass through the fourth electrode element during assembly of the grids into a gun.

4. The electron gun according to claim 2 wherein the inside diameter of the first end of the unitary electrode end is greater than the outside diameter of the first electrode element, whereby the first electrode element is able to pass through the first end of the unitary electrode during assembly of the grids into a gun.

5. The electron gun according to claim 1 wherein each of said first through fourth electrode elements of the main lens region are composed of separate electrodes.

6. An electron gun for a cathode ray tube comprising:

A. a beam forming region constructed and arranged to emit electrons and form them into a beam;

B. a main lens region constructed and arranged to receive the beam from the beam forming region and having:

1) a decelerating lens gap comprising:

a) a substantially tubular first high voltage electrode element having an electrical connection adapted to receive a first electron accelerating voltage, and b) a substantially tubular first low voltage electrode element surrounding at least a portion of the first high voltage electrode element and having an electrical connection adapted to receive a first electron decelerating voltage;

2) an accelerating lens gap, comprising:

a) a substantially tubular second low voltage electrode element having an electrical connection adapted to receive a second electron decelerating voltage, and b) a substantially tubular second high voltage electrode element surrounding at least a portion of the second low voltage electrode element and having an electrical connection adapted to receive a second electron accelerating voltage; and 3) the decelerating lens gap being located between the beam forming region and the accelerating lens gap.

7. The electron gun according to claim 6 wherein the first and second low voltage electrode element electrical connections are adapted to receive the same electron decelerating voltage.

8. The electron gun according to claim 6 wherein the first and second high voltage electrode electrical connections are adapted to receive the same electron accelerating voltage.

9. The electron gun according to claim 8 wherein the first and second low voltage electrode elements are opposite ends of a unitary electrode.

10. The electron gun according to claim 9 wherein the first and second high voltage electrode electrical connections are adapted to receive the same electron accelerating voltage.

11. The electron gun according to claim 6 wherein the first and second low voltage electrode elements are opposite ends of a unitary electrode.

12. An electron gun for a cathode ray tube comprising:

A. a beam forming structure having 1) a cathode for emitting electrons and 2) at least one electrode for forming the electrons into a beam, and B. a main lens structure having, in order from the cathode:

1) a first substantially tubular grid having upper and lower ends, 2) a second substantially tubular grid having upper and lower ends, and 3) a third substantially tubular grid having upper and lower ends;

the first grid upper end being surrounded by the second grid lower end; and the second grid upper end being surrounded by the third grid lower end.

13. The electron gun according to claim 12 wherein the outside diameter of the first grid upper end is less than the inside diameter of the second grid lower end whereby the first grid upper end is able to pass through the second grid lower end during assembly of the grids into a gun.

14. The electron gun according to claim 12 wherein the outside diameter of the second grid upper end is less than the inside diameter of the third grid lower end whereby the second grid upper end is able to pass through the third grid lower end during assembly of the grids into a gun.

15. The electron gun according to claim 13 wherein the outside diameter of the second grid upper end is less than the inside diameter of the third grid lower end whereby the second grid upper end is able to pass through the third grid lower end during assembly of the grids into a gun.

16. The electron gun according to claim 12 wherein:

the first, second and third grids are each structurally separate and unitary pieces with the grids individually connected to an insulating support member.

17. The electron gun according to claim 13 wherein:

the first, second and third grids are each structurally separate and unitary pieces with the grids individually connected to an insulating support member.

18. The electron gun according to claim 14 wherein:

the first, second and third grids are each structurally separate and unitary pieces with the grids individually connected to an insulating support member.

19. The electron gun according to claim 15 wherein:

the first, second and third grids are each structurally separate and unitary pieces with the grids individually connected to an insulating support member.

20. An electron gun for a cathode ray tube comprising:

A. a beam forming structure having
1) a cathode,
2) a control electrode G1,
3) an accelerating electrode G2, and B. a main lens structure having, in order from the cathode:
1) a first accelerating grid G3 having upper and lower ends,
2) a second decelerating grid G4 having upper and lower ends,
3) a third accelerating grid G5 having upper and lower ends;

C. the G3 grid upper end being surrounded by the G4 grid lower end;

D. the G4 grid upper end being surrounded by the G5 grid; and

E. the G3, G4 and G5 grids being unitary pieces with each of the grids being individually connected to an insulating support member.

21. The electron gun of claim 20 wherein:

A. the G3 grid upper end outer diameter is less than the G4 grid lower end inner diameter, and B. the G4 grid upper end outer diameter is less than the G5 grid lower end inner diameter.

22. The electron gun of claim 21 wherein the diameter of the G4 grid lower end is substantially the maximum permitted by the insulative support beads.

23. The electron gun of claim 20 wherein the electron gun conforms to the equation:

$$a<=b-2((Vacc-Vdec)/Emax)-2t,$$

where

Vacc=Electric potential of G3,

Vdec=Electric potential of G4, b=G4 lower diameter maximized to fit within bead pillars, t=metal wall thickness, a=G3 diameter, and Emax=maximum electrical field constraint.

24. The electron gun of claim 23 wherein the electron gun conforms to the equation:

$$e<=f-2((Vacc-Vdec)/Emax)-2t,$$

where

Vacc=Electric potential of G5,

Vdec=Electric potential of G4, f=G5 diameter maximized to fit within 29 mm neck, t=metal wall thickness, e=G4 upper diameter, and Emax=maximum electrical field constraint.

25. The electron gun of claim 20 wherein the electron gun conforms to the equation:

$$e<=f-2((Vacc-Vdec)/Emax)-2t,$$

where

Vacc=Electric potential of G5,

Vdec=Electric potential of G4, f=G5 diameter maximized to fit within 29 mm neck, t=metal wall thickness, e=G4 upper diameter, and Emax=maximum electrical field constraint.

26. An electron gun for a cathode ray tube comprising:

A. a beam forming structure having
2) at least one electrode for forming the electrons into a beam, and B. a main lens structure having, in order from the cathode:
1) a first substantially tubular grid having upper and lower ends,
2) a second substantially tubular grid having upper and lower ends, and
3) a third substantially tubular grid having upper and lower ends;
4) a fourth substantially tubular grid having upper and lower ends the first grid upper end being surrounded by the second grid lower end;

the second grid upper end being surrounded by the third grid lower end; and the third grid upper end being surrounded by the fourth grid lower end.

27. The electron gun according to claim 26 wherein the outside diameter of the first grid upper end is less than the inside diameter of the second grid lower end, whereby the first grid upper end is able to pass through the second grid lower end during assembly of the grids into a gun.

28. The electron gun according to claim 26 wherein the outside diameter of the second grid upper end is less than the inside diameter of the third grid lower end whereby the second grid upper end is able to pass through the third grid lower end during assembly of the grids into a gun.

29. The electron gun according to claim 26 wherein the outside diameter of the third grid upper end is less than the inside diameter of the fourth grid lower end whereby the third grid upper end is able to pass through the fourth grid lower end during assembly of the grids into a gun.

30. The electron gun according to claim 27 wherein the outside diameter of the second grid upper end is less than the inside diameter of the third grid lower end whereby the second grid upper end is able to pass through the third grid lower end during assembly of the grids into a gun.

31. The electron gun according to claim 30 wherein the outside diameter of the third grid upper end is less than the inside diameter of the fourth grid lower end whereby the third grid upper end is able to pass through the fourth grid lower end during assembly of the grids into a gun.

32. The electron gun according to claim 26 wherein:

the first, second, third and fourth grids are each structurally separate and unitary pieces with the grids individually connected to an insulating support member.

33. An electron gun for a cathode ray tube comprising:

A. a beam forming structure having 1) a cathode,
2) a control electrode G1,
3) an accelerating electrode G2, and B. a main lens structure having, in order from the cathode:
1) a first accelerating grid G3 having upper and lower ends,
2) a second decelerating grid G4 having upper and lower ends,
3) a third accelerating grid G5 having upper and lower ends, C. the G3 grid upper end being surrounded by the G4 grid lower end;

D. the G4 grid upper end being surrounded by the G5 grid; and

E. the G3, G4 and G5 grids being unitary pieces with each of the grids being individually connected to an insulating support member;

F. the G3 grid upper end outer diameter being less than the G4 grid lower end inner diameter, G. the G4 grid upper end outer diameter being less than the G5 grid lower end inner diameter;

H. the diameter of the G4 grid lower end being substantially the maximum permitted by the insulative support beads.

34. An electron gun for a cathode ray tube comprising:

A. a beam forming structure having
1) a cathode,
2) a control electrode G1,
3) an accelerating electrode G2, and B. a main lens structure having, in order from the cathode:
1) a first accelerating grid G3 having upper and lower ends,
2) a second decelerating grid G4 having upper and lower ends,
3) a third accelerating grid G5 having upper and lower ends;

C. the G3 grid upper end being surrounded by the G4 grid lower end;

D. the G4 grid upper end being surrounded by the G5 grid; and

E. the G3, G4 and G5 grids being unitary pieces with each of the grids being individually connected to an insulating support member; and F. wherein the electron gun conforms to the equation:

$$a<=b-2((Vacc-Vdec)/Emax)-2t,$$

where

Vacc=Electric potential of G3,

Vdec=Electric potential of G4, b=G4 lower diameter maximized to fit within bead pillars, t=metal wall thickness, a=G3 diameter, and Emax=maximum electrical field constraint.

35. The electron gun of claim 34 wherein the electron gun conforms to the equation:

$$e<=f-2((Vacc-Vdec)/Emax)-2t,$$

where

Vacc=Electric potential of G5,

Vdec=Electric potential of G4, f=G5 diameter maximized to fit within 29 mm neck, t=metal wall thickness, e=G4 upper diameter, and Emax=maximum electrical field constraint.

36. An electron gun for a cathode ray tube comprising:

A. a beam forming structure having
1) a cathode,
2) a control electrode G1,
3) an accelerating electrode G2, and B. a main lens structure having, in order from the cathode:
1) a first accelerating grid G3 having upper and lower ends,
2) a second decelerating grid G4 having upper and lower ends,
3) a third accelerating grid G5 having upper and lower ends;

C. the G3 grid upper end being surrounded by the G4 grid lower end;

D. the G4 grid upper end being surrounded by the G5 grid; and

E. the G3, G4 and G5 grids being unitary pieces with each of the grids being individually connected to an insulating support member; and F. wherein the electron gun conforms to the equation:

$$e<=f-2((Vacc-Vdec)/Emax)-2t,$$

where

Vacc=Electric potential of G5,

Vdec=Electric potential of G4, f=G5 diameter maximized to fit within 29 mm neck, t=metal wall thickness, e=G4 upper diameter, and Emax=maximum electrical field constraint.

* * * * *